US012351980B2

(12) United States Patent
Zhang et al.

(10) Patent No.: US 12,351,980 B2
(45) Date of Patent: Jul. 8, 2025

(54) STEEL CORD FOR RUBBER REINFORCEMENT

(71) Applicant: NV BEKAERT SA, Zwevegem (BE)

(72) Inventors: Aijun Zhang, Jiangyin (CN); Haijun Ma, Jiangyin (CN)

(73) Assignee: NV BEKAERT SA, Zwevegem (BE)

( * ) Notice: Subject to any disclaimer, the term of this patent is extended or adjusted under 35 U.S.C. 154(b) by 0 days.

(21) Appl. No.: 18/571,858

(22) PCT Filed: Jun. 20, 2022

(86) PCT No.: PCT/EP2022/066680

§ 371 (c)(1),
(2) Date: Dec. 19, 2023

(87) PCT Pub. No.: WO2023/285075

PCT Pub. Date: Jan. 19, 2023

(65) Prior Publication Data

US 2024/0360621 A1 Oct. 31, 2024

(30) Foreign Application Priority Data

Jul. 13, 2021 (WO) ..... PCT/CN2021/105934

(51) Int. Cl.
*D07B 1/06* (2006.01)

(52) U.S. Cl.
CPC ..... *D07B 1/062* (2013.01); *D07B 2201/1044* (2013.01); *D07B 2201/2007* (2013.01);
(Continued)

(58) Field of Classification Search
CPC ..... D07B 1/06; D07B 1/062; D07B 1/0626; D07B 1/0633; D07B 2201/1044;
(Continued)

(56) References Cited

U.S. PATENT DOCUMENTS 5,287,691 A * 2/1994 Okamoto ..... D07B 1/0646 57/902
5,784,874 A * 7/1998 Bruyneel ..... F16G 1/12 57/902
(Continued)

FOREIGN PATENT DOCUMENTS

JP 2005-169484 6/2005
JP 2009-249799 10/2008
(Continued)

OTHER PUBLICATIONS

International Search Report issued Aug. 30, 2022 in International Application No. PCT/EP2022/066680.
(Continued)

*Primary Examiner* — Bao-Thieu L Nguyen
(74) *Attorney, Agent, or Firm* — Wenderoth, Lind & Ponack, L.L.P.

(57) ABSTRACT

The invention provides a steel cord, the steel cord comprises two or more steel filaments, at least one of the steel filaments has a twist pitch of 6 mm to 40 mm, each of the steel filaments has a tip rise of less than 5 mm with a gauge length of 200 mm after being unravelled out of the steel cord. The invention steel cord has an improved straightness with reduced steel filament fracture risk.

15 Claims, 2 Drawing Sheets

Figure 1A:
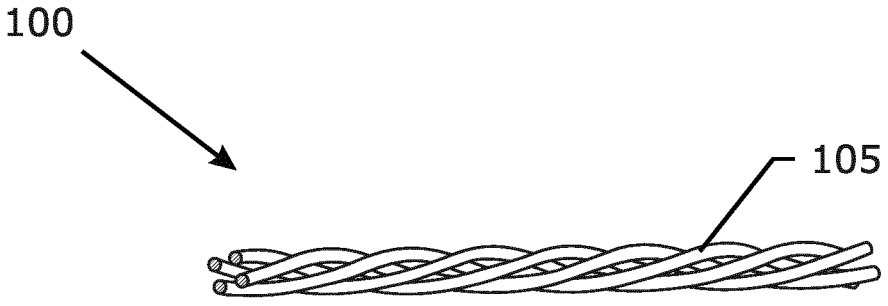

(52) U.S. Cl.
CPC ..... *D07B 2201/2009* (2013.01); *D07B 2205/3025* (2013.01); *D07B 2501/2046* (2013.01)

(58) Field of Classification Search
CPC .... D07B 2201/2007; D07B 2201/2008; D07B 2201/2009; D07B 2205/3025; D07B 2205/2045
See application file for complete search history.

(56) References Cited

U.S. PATENT DOCUMENTS

| | | | | |
|---|---|---|---|---|
| 6,253,536 | B1 * | 7/2001 | Han | D07B 1/062 57/902 |
| 2017/0073888 | A1 * | 3/2017 | Gallet | D07B 7/022 |
| 2023/0002968 | A1 * | 1/2023 | Agresti | D07B 1/062 |
| 2023/0234398 | A1 * | 7/2023 | Agresti | D02G 3/48 152/451 |
| 2023/0366149 | A1 * | 11/2023 | Agresti | D07B 1/062 |
| 2024/0075772 | A1 * | 3/2024 | Zhang | D07B 1/0633 |

FOREIGN PATENT DOCUMENTS

| | | |
|---|---|---|
| KR | 2009-0073295 | 7/2009 |
| WO | 2015/169521 | 11/2015 |
| WO | 2021/008853 | 1/2021 |

OTHER PUBLICATIONS

Written Opinion issued Aug. 30, 2022 in International Application No. PCT/EP2022/066680.

* cited by examiner

STEEL CORD FOR RUBBER REINFORCEMENT

TECHNICAL FIELD

The invention relates to a steel cord for rubber reinforcement. The invention also relates to a rubber article reinforced by the steel cords.

BACKGROUND ART

Steel cord is widely used as a reinforcement for rubber product, such as rubber belt, rubber tire, hose and etc.

A rubber ply which is embedded with steel cords in parallel is one component for tire making. The rubberized steel cord ply is further processed by being cut into small pieces with a certain length, width and thickness. The rubberized steel cord ply is being cut with an angle oblique with the longitudinal axis of the rubberized steel cord ply or being cut perpendicularly to the longitudinal axis of the rubberized steel cord ply. Subsequently, the small pieces of rubber ply, all with the same shape are spliced to a desired length for one tire by machine.

It occurs that after cutting, one or some of the four corners of the small piece of rubberized steel cord ply sometimes rise out of the plane. If the corner rises a certain height, such as ten or more millimetres, this will make the automatic machine splicing impossible, then the splicing can only be done manually, and this leads to a reduced working efficiency. This is so-called "rubber ply tip rise" problem. The rubber ply tip rise problem is mostly caused by the poor straightness of the steel cord.

As a common knowledge, the steel cord is straightened before being taken up to improve the straightness of the steel cord.

JP2009249799 discloses a steel cord with an improved straightness, and the improved straightness is realized by using a straightener comprising rollers arranged in a staggered patter. JP2009249799 also discloses that the method taught by JP2005169484 for improving the straightness of the steel filament by giving a rotation to the steel filaments is not available for improving the straightness of the steel cord, oppositely, the steel cord made by such steel filaments has worse straightness according to JP2009249799.

However, the straightening process makes the steel cord bending multiple times, and the multiple times bending damages the steel filaments of the steel cord, and the damaged steel filaments bring a risk of steel filament fracture or breaking during the use of the tire. With the increase of the tensile strength of the steel filaments of the steel cord, the damage from the straightener to steel filaments increases, and the risk of steel filament fracture or breaking during the use of the tire increases.

DISCLOSURE OF INVENTION

The primary object of the invention is to solve the problem of the prior arts.

The second object of the invention is to provide a straight steel cord with reduced wire fracture risk.

The third object of the invention is to provide a tire reinforced by the straight steel cords.

According to the first aspect of the invention, a steel cord is provided, the steel cord comprises two or more steel filaments, at least one of the steel filaments has a twist pitch of 6 mm to 40 mm, each of the steel filaments has a tip rise of less than 5 mm with a gauge length of 200 mm after being unravelled out of the steel cord. This means that for the steel filaments which are unravelled out of the steel cord, each of the steel filaments is measured to have a tip rise of less than 5 mm with a gauge length of 200 mm. The steel filament tip rise measurement is done on the steel filaments which are unravelled out of the steel cord.

The invention steel cord has an improved straightness with reduced steel filament fracture risk. Particularly, the invention is very beneficial for the steel cord comprising steel filaments with higher tensile strength for reducing the filament fracture risk during the use of the tire.

Preferably, each of the steel filaments has a tip rise of less than 4 mm with a gauge length of 200 mm after being unravelled out of the steel cord. More preferably, each of the steel filaments has a tip rise of less than 3 mm with a gauge length of 200 mm after being unravelled out of the steel cord.

Preferably, the average of the tip rise of steel filaments of steel cord is less than 2.5 mm. As a result, the steel filaments have a relatively uniform straightness. This is beneficial for the steel cord straightness. More preferably, the average of the tip rise of steel filaments of steel cord is less than 2.0 mm. The average of the tip rise of steel filaments of steel cord is more than 0.02 mm.

Preferably, each of the steel filaments has a tensile strength of more than 4000-2000×D MPa after being unravelled out of the steel cord, D being the diameter of the steel filament expressed in mm. More preferably, each of the steel filaments of the steel cord has a tensile strength of more than 4200-2000×D MPa. Most preferably, each of the steel filaments of the steel cord has a tensile strength of more than 4300-2000×D MPa. Tensile strength of the steel filament is measured on the steel filament which is unravelled out of the steel cord. A steel cord is made by twisting several steel filaments which are drawn from wire rods. The final drawing processes are so-called wet drawing processes, that the wet drawn steel filaments are ready for being twisted for forming a steel cord. Normally the steel filaments after wet drawing are not straight, when the steel filaments have a tensile strength higher than 4200-2000×D MPa. And such higher tensile strength steel filaments are less plastically deformed during the twisting operation or straightening operation which are the normal operations for forming a steel cord, that the twisting operation or straightening operation brings less change or improvement on the straightness of the steel filaments, so that the problem of bad straightness of the steel filaments is still existing, and this leads to un-straight steel cord. The invention solves the problem particular for the steel cord with the steel filaments having a tensile strength higher than 4200-2000×D MPa.

Preferably, each of the steel filament has a diameter D ranging from 0.17-0.45 mm. The steel filaments of the steel cord may have the same diameter or the different diameter.

Preferably, each of the steel filaments of the steel cord has a twist pitch of 6-40 mm. The steel filaments of the steel cord may have the same twist pitch or the different twist pitch.

As a preferable solution, the steel cord has a construction of n×1, wherein the steel cord has a cord twist pitch of 6-40 mm, preferably of 10-36 mm, in other words, the steel filaments of the steel cord has a twist pitch of 6-40 mm, preferable of 10-36 mm. Preferably, n is 3-6. Mostly preferably, n is 4. Alternatively, the steel cord may have any one of the existing construction.

The invention steel cord is used for rubber reinforcement.

According to the present invention, the steel cord has an arc height of less than 15 mm. This means the invention steel cord is very straight.

According to a second aspect of the invention, a tire is provided, the tire comprises at least one belt layer, at least one carcass layer, at least one tread layer and a pair of bead portions, wherein the belt layer and/or the carcass layer comprises at least one steel cord, the steel cord comprises two or more steel filaments, at least one of the steel filaments has a twist pitch of 6 mm to 40 mm, each of the steel filaments has a tip rise of less than 5 mm with a gauge length of 200 mm after being unravelled out of the steel cord.

BRIEF DESCRIPTION OF FIGURES IN THE DRAWINGS

Figure 1B:
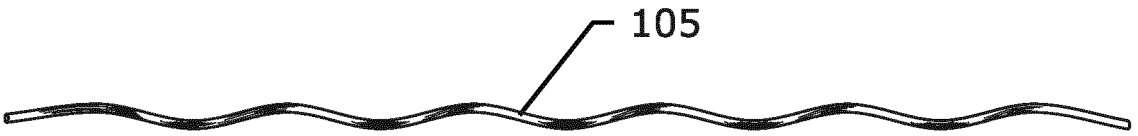

FIGS. 1*a*-1*b* describe the invention steel cord and one steel filament unravelled out of the steel cord.

Figure 2:
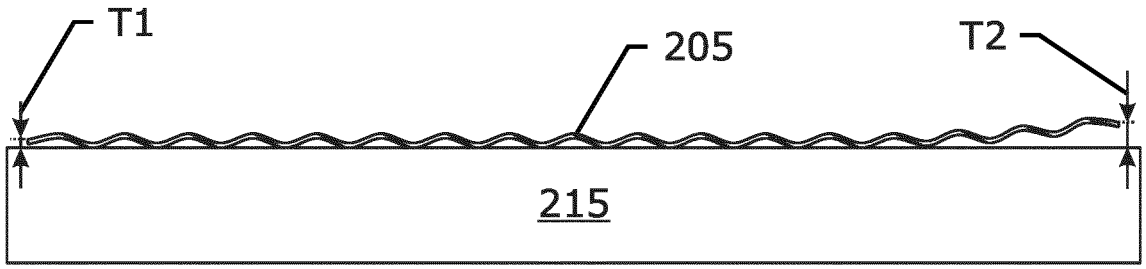

FIG. 2 describes the measurement of tip rise of steel filament.

MODE(S) FOR CARRYING OUT THE INVENTION

The steel filaments for steel cord are made from a wire rod.

The wire rod is firstly cleaned by mechanical descaling and/or by chemical pickling in a $H_2SO_4$ or HCl solution in order to remove the oxides present on the surface. The wire rod is then rinsed in water and is dried. The dried wire rod is then subjected to a first series of dry drawing operations in order to reduce the diameter until a first intermediate diameter.

At this first intermediate diameter, e.g. at about 3.0 to 3.5 mm, the dry drawn steel filament is subjected to a first intermediate heat treatment, called patenting. Patenting means first austenitizing until a temperature of about 1000° C. followed by a transformation phase from austenite to pearlite at a temperature of about 600-650° C. The steel filament is then ready for further mechanical deformation.

Thereafter the steel filament is further dry drawn from the first intermediate diameter until a second intermediate diameter in a second number of diameter reduction steps. The second diameter typically ranges from 1.0 mm to 2.5 mm.

At this second intermediate diameter, the steel filament is subjected to a second patenting treatment, i.e. austenitizing again at a temperature of about 1000° C. and thereafter quenching at a temperature of 600 to 650° C. to allow for transformation to pearlite.

If the total reduction in the first and second dry drawing step is not too big a direct drawing operation can be done from wire rod till second intermediate diameter.

After this second patenting treatment, the steel filament is usually provided with a brass coating: copper is plated on the steel filament and zinc is plated on the copper. A thermos-diffusion treatment is applied to form the brass coating. Alternatively, the steel filament can be provided with a ternary alloy coating, including copper, zinc and a third alloy of cobalt, titanium, nickel, iron or other known metal.

The brass-coated or the ternary alloy coated steel filament is then subjected to a final series of cross-section reductions by means of wet drawing machines. The cast of wet drawn steel filament is controlled to be more than 250 mm. The multi-dimensions straighters, i.e. two, three or more straighters, are used to adjust the cast of the wet drawn steel filament. Alternatively, the high cast can be realized by adjusting the position of the last drawing die. Wet drawing process includes a series of drawing passes by various drawing dies. Drawing dies are kept in the drawing die holders for well positioning, i.e. the drawing die holders are used for fixing the drawing dies. The drawing die holder of the last drawing die (for final drawing pass) is adjustable on its position, while the position of the drawing die holders of the other drawing dies is not adjustable. Normally the postion of the last drawing die holder is adjusted manually according to the operator's personal experience, however, this manual operation makes uncertainty of the postion of the last drawing die holder and the postion of the last drawing die correspondingly, for example, the central axis of the last drawing die is not substantially in the same line with the central axis of the previous drawing die, and this makes the filaments unstraight after final drawing pass. The invention solves the problem, the relative position between the last drawing die and the previous drawing die is more accurately adjusted by a laser line. A laser transmitter is set at the outlet of the last drawing die, while a laser receiver is set at the inlet of the previous drawing die. A laser line starts from the laser transmitter, and transfers through the last drawing die and then the previous drawing die, and finally arrives at the laser receiver. By doing this, it is sure that the central axis of the last drawing die and the central axis of the previous drawing die are in the same line. After this, a very straight wet drawn steel filament is obtained. By making the cast of wet drawn steel filament bigger, the wet drawn steel filament is more straight, this is benefit to have the steel filament unravelled from the steel cord with a lower tip rise.

The final steel filament is a very straight steel filament with a carbon content higher than 0.70 percent by weight, or no less than 0.80 percent by weight, or even higher than 0.90 percent by weight, with a tensile strength (TS) preferably of more than 4000-2000×D MPa, and adapted for the reinforcement of rubber products.

Steel filaments adapted for the reinforcement of tires typically have a final diameter D ranging from 0.05 mm to 0.60 mm, e.g. from 0.10 mm to 0.40 mm. Examples of wire diameters are 0.10 mm, 0.12 mm, 0.15 mm, 0.175 mm, 0.18 mm, 0.20 mm, 0.22 mm, 0.245 mm, 0.28 mm, 0.30 mm, 0.32 mm, 0.35 mm, 0.38 mm, 0.40 mm, 0.45 mm, 0.50 mm. Better that the diameter the steel filament D is in the range of 0.17 mm-0.45 mm.

Two or more steel filaments are twisted by the existing steel cord producing process, i.e. cabling or bunching process, to form a steel cord. Very important to control the length of each steel filament starting from pay-off spools to the bunching point wherein the steel filaments gather and start to winding, and to make sure that the difference of such length among the steel filaments being smaller than 100 mm. This is benefit to have the steel filament unravelled from the steel cord with a lower tip rise.

The invention avoids the usage of the straightener prior to steel cord taking up which is for improving the straightness of the steel cord as mentioned in JP2009249799, thereby avoids the damage from the straightening operation to the steel filament, as thus the filament fracture risk during the use of the tire is reduced. Particularly, the steel filaments with higher tensile strength is relatively more easier to be damaged comparing with the steel filaments with relatively lower tensile strength. Furthermore, as mentioned previously, for the steel cord with the steel filaments having a higher tensile strength, i.e., higher than 4200-2000×D MPa, the straightening operation can't bring the desired effect, that the steel cord is still not straight after straightening operation. The invention is beneficial for the steel cord with higher tensile strength steel filaments. The invention avoids the use of rolling and rotating process as mentioned in JP2005169484 before the cabling or bunching process, thereby avoids the damage to the straightness of the steel cord.

Table 1 shows the comparison between the invention steel cord and the references.

TABLE 1

| | Reference 1 | Reference 2 | Invention |
|---|---|---|---|
| Construction | 4 × 1 | 4 × 1 | 4 × 1 |
| Steel filament diameter (mm) | 0.225 | 0.225 | 0.225 |
| Use of rotary rollers before cabling or bunching process | No | No | No |
| Steel filament twist pitch (mm) | 12 | 12 | 12 |
| Use of straightener after cabling or bunching process | No | Yes | No |
| TS of each steel filament (MPa) | ≥3790 | ≥3796 | ≥3792 |
| Highest tip rise among the steel filaments unravelled out of steel cord (mm) | 7 | 6 | 2 |
| Average of the tip-rise of steel filaments unravelled out of steel cord (mm) | 3.5 | 3.4 | 1.3 |
| Steel cord straightness (mm) | 43 | 12 | 10 |
| Steel cord arc height (mm) | 23 | 8 | 9 |
| Rubber ply tip rise (mm) | 10-15 | <5 | <5 |

The above table shows that the invention steel cord is very straight by reducing the tip rise of the individual steel filament. Reference 2 steel cord is straight, however, the straightness of steel cord is realized by using the straightener, and the straightening operation may damage the steel filaments, and such damage brings the risk of steel filament fracture or breaking during the running of the tire, and both the tip rise of the individual steel filament and the average of tip rise of steel filaments are higher.

FIG. 1*a* shows the invention steel cord 100 with a construction of 4×1 comprising four steel filaments 105, FIG. 1*b* shows the steel filament 105 which is unravelled out of the steel cord 100.

A method of measuring the tip rise of steel filaments unravelled of the steel cord is provided, and FIG. 2 illustrates the measurement, a) Unravel all steel filaments out of the steel cord, b) Cut one unravelled steel filament consecutively to have 6 samples 205 with a length 200 mm+/−5 mm, this length is so-called "gauge length of 200 mm"; put one sample 205 on the horizontal table top of the worktable 215, and measure the distance from each of the two ends of the sample 205 to the horizontal table top by the ruler and record the value of distance as T1 and T2, and the measurement is according to the highest point of each end of the sample 205, thereby the steel filament diameter is included into the distance, the bigger value between T1 and T2 of is deemed as the tip rise of the sample 205; and then measure the rest 5 samples, the highest value of the tip rise of the 6 samples is deemed as the tip rise of the unravelled steel filament.

c) Measure the rest unravelled steel filaments in the same way and get the tip rise of the rest unravelled steel filaments, calculate the average of the tip rise of all the unravelled steel filaments, and this is the average of the tip rise of steel filaments.

The method of testing and calculating the tensile strength of each steel filament includes:

Unravel the steel filaments from the steel cord,

Measure the filament breaking load according to the principle mentioned in the standard ISO6892-1:2019 with some particular setting like the clamp length being 250 mm and the test speed being 100 mm/min, test 5 times for each filament and calculate the average as the breaking load of the individual steel filament, Calculate the tensile strength of individual filament by dividing the filament breaking load by the filament cross-sectional area.

The steel cord straightness and steel cord arc height are measured according to the method mentioned in China standard GB/T 33159-2016.

The invention claimed is:

1. A steel cord comprising two or more steel filaments, at least one of said steel filaments has a twist pitch of 6 mm to 40 mm, wherein each of said two or more steel filaments has a tip rise of less than 5 mm, the tip rise of steel filament being measured by unravelling the steel filament from the steel cord, cutting the steel filament to have 6 samples with a gauge length of 200 mm, measuring a tip rise for each sample, and taking the highest value of the tip rise of 6 samples as the tip rise of the steel filament.

2. The steel cord according to claim 1, wherein each of said steel filaments has a tip rise of less than 4 mm.

3. The steel cord according to claim 2, wherein each of said steel filaments has a tip rise of less than 3 mm.

4. The steel cord according to claim 1, wherein the average of the tip rise of said two or more steel filaments is less than 2.5 mm and more than 0.02 mm.

5. The steel cord according to claim 4, wherein the average of the tip rise of said two or more steel filaments is less than 2.0 mm.

6. The steel cord according to claim 1, wherein each of said two or more steel filaments has a tensile strength, measured on the steel filament unravelled out of the steel cord, of more than 4000-2000×D MPa, D being the diameter of the steel filament expressed in mm.

7. The steel cord according to claim 6, wherein each of said two or more steel filaments has a tensile strength of more than 4200-2000×D MPa.

8. The steel cord according to claim 7, wherein each of said two or more steel filaments has a tensile strength of more than 4300-2000×D MPa.

9. The steel cord according to claim 1, wherein each of said steel filament has a diameter D ranging from 0.17-0.45 mm.

10. The steel cord according to claim 1, wherein each of said steel filaments has a twist pitch of 6 mm to 40 mm.

11. The steel cord according to claim 1, wherein said steel cord has a construction of n×1, each of the steel filaments has a twist pitch of 10 mm to 36 mm.

12. The steel cord according to claim 11, wherein said n is 3-6.

13. The steel cord according to claim 12, wherein said n is 4.

14. The steel cord according to claim 1, wherein said steel cord has an arc height of less than 15 mm.

15. A tire comprising at least one belt layer, at least one carcass layer, at least one tread layer and a pair of bead portions, wherein said belt layer and/or said carcass layer comprises at least one steel cord according to claim 1.

* * * * *